US012618403B2

(12) United States Patent
Gilmore et al.

(10) Patent No.: US 12,618,403 B2
(45) Date of Patent: May 5, 2026

(54) ADAPTIVE PROGRAMMABLE PUMP

(71) Applicant: Toyota Motor Engineering & Manufacturing North America, Inc., Plano, TX (US)

(72) Inventors: Paul Gilmore, Ann Arbor, MI (US); Umesh Gandhi, Farmington Hills, MI (US)

(73) Assignees: TOYOTA MOTOR ENGINEERING & MANUFACTURING NORTH AMERICA, INC., Plano, TX (US); TOYOTA JIDOSHA KABUSHIKI KAISHA, Toyota (JP)

( * ) Notice: Subject to any disclaimer, the term of this patent is extended or adjusted under 35 U.S.C. 154(b) by 228 days.

(21) Appl. No.: 18/309,399

(22) Filed: Apr. 28, 2023

(65) Prior Publication Data

US 2024/0360824 A1 Oct. 31, 2024

(51) Int. Cl.
*F04B 49/06* (2006.01)
*F04B 45/047* (2006.01)

(52) U.S. Cl.
CPC ..... *F04B 49/06* (2013.01); *F04B 45/047* (2013.01); *F04B 2205/05* (2013.01); *F04B 2205/09* (2013.01)

(58) Field of Classification Search
CPC .... F04B 17/003; F04B 43/046; F04B 43/095; F04B 43/0054; F04B 45/047; F04B 49/06; F04B 2205/05; F04B 2205/09
See application file for complete search history.

(56) References Cited

U.S. PATENT DOCUMENTS 6,227,809 B1 * 5/2001 Forster ..... F16K 99/0057 417/413.2
9,127,665 B2 9/2015 Locke et al.
(Continued)

FOREIGN PATENT DOCUMENTS

CN 208416839 U * 1/2019 ..... F04B 13/00
WO WO-2014016562 A1 * 1/2014 ..... F04B 19/006
(Continued)

OTHER PUBLICATIONS

CN_208416839_MT; machine translation of CN-208416839-U.*
(Continued)

*Primary Examiner* — Wesley G Harris
*Assistant Examiner* — Charles W Nichols
(74) *Attorney, Agent, or Firm* — Jordan IP Law, LLC

(57) ABSTRACT

An adaptive programmable pump includes a pump housing, a diaphragm comprising a variable stiffness element attached to the pump housing, a piezoelectric element operatively connected to the diaphragm, and a control element coupled to the variable stiffness element, where the control element is configured to control a stiffness of the variable stiffness element via a voltage applied to the control element. The pump can also include a controller configured to decrease the stiffness of the variable stiffness element responsive to a high flow rate condition for the pump and/or increase the stiffness of the variable stiffness element responsive to a high pressure condition for the pump. The variable stiffness element can include a thermoplastic material with stiffness controlled by applying heat, an amorphous metal alloy with stiffness controlled by applying a magnetic field, or an electroactive laminate with stiffness controlled by applying an electric field.

14 Claims, 6 Drawing Sheets

(56) References Cited

U.S. PATENT DOCUMENTS

| | | | | |
|---|---|---|---|---|
| 9,506,463 | B2 | 11/2016 | Locke et al. | |
| 2009/0148317 | A1 * | 6/2009 | Pietron | F04B 43/046 417/413.2 |
| 2010/0310397 | A1 | 12/2010 | van Rensburg | |

FOREIGN PATENT DOCUMENTS

| | | | | |
|---|---|---|---|---|
| WO | WO-2020208532 | A1 * | 10/2020 | A61M 1/281 |
| WO | WO-2022136275 | A1 * | 6/2022 | F04B 11/0091 |

OTHER PUBLICATIONS

David J. Levine et al., "Materials with Electroprogrammable Stiffness", Advanced Materials 2021, DOI: 10.1002/adma.2007952, 26 pages.

* cited by examiner

ADAPTIVE PROGRAMMABLE PUMP

TECHNICAL FIELD

Embodiments generally relate to piezoelectric pumps. More particularly, embodiments relate to an adaptive piezoelectric pump having a variable stiffness diaphragm element that is controllable to change the stiffness responsive to pumping conditions.

BACKGROUND

State-of-the-art piezoelectric pumps have an isolator that is part of the diaphragm. The isolator is a thin, flexible membrane which connects the rest of the diaphragm (with connected piezoelectric element) to the side wall of the pump. The isolator allows the volume displacement of the diaphragm to be increased and also creates the desired mode shape of the diaphragm. However, the isolator leads to a reducing in bending stiffness of the diaphragm, therefore reducing the maximum backpressure of the pump.

BRIEF SUMMARY

In some embodiments, an adaptive programmable pump includes a pump housing, a diaphragm comprising a variable stiffness element attached to the pump housing, a piezoelectric element operatively connected to the diaphragm, and a control element coupled to the variable stiffness element, wherein the control element is configured to control a stiffness of the variable stiffness element via a voltage applied to the control element.

In some embodiments, a method of controlling an adaptive programmable pump includes monitoring one of a pressure or a flow rate of a fluid in the adaptive programmable pump, wherein the adaptive programmable pump comprises a diaphragm that includes a variable stiffness element, determining a level of stiffness of the variable stiffness element that is required for operation of the adaptive programmable pump, and controlling the stiffness of the variable stiffness element by applying a voltage to a control element coupled to the variable stiffness element.

In some embodiments, at least one non-transitory computer readable storage medium includes instructions which, when executed by a controller, cause the controller to perform operations comprising monitoring one of a pressure or a flow rate of a fluid in an adaptive programmable pump, wherein the adaptive programmable pump comprises a diaphragm that includes a variable stiffness element, determining a level of stiffness of the variable stiffness element that is required for operation of the adaptive programmable pump, and controlling the stiffness of the variable stiffness element by applying a voltage to a control element coupled to the variable stiffness element.

BRIEF DESCRIPTION OF THE SEVERAL VIEWS OF THE DRAWINGS

The various advantages of the embodiments will become apparent to one skilled in the art by reading the following specification and appended claims, and by referencing the following drawings, in which:

DETAILED DESCRIPTION

In accordance with the technology disclosed herein, an adaptive programmable pump includes a diaphragm with a variable stiffness element that can be controlled to vary the stiffness. The stiffness (e.g., bending stiffness of the diaphragm or isolator), which is a property of the material(s) and/or configuration of the variable stiffness element, can be controlled by a control signal (e.g. an applied voltage) which, when applied to a control element, provides control over the variable stiffness element via a thermal, electrical field, or magnetic field input. The disclosed technology provides improved pump performance under variable pressure or flow rate conditions. For example, the adaptive programmable pump can be programmed such that the variable stiffness element is controlled to be in a low stiffness state (i.e., more flexible) when a high flowrate is required, thus increasing the volume displacement of diaphragm. As another example, when a high pressure is required, the adaptive programmable pump can be programmed such that the variable stiffness element is controlled to be in a high stiffness state (i.e., less flexible), thus increasing the bending stiffness of the diaphragm.

Figure 1:
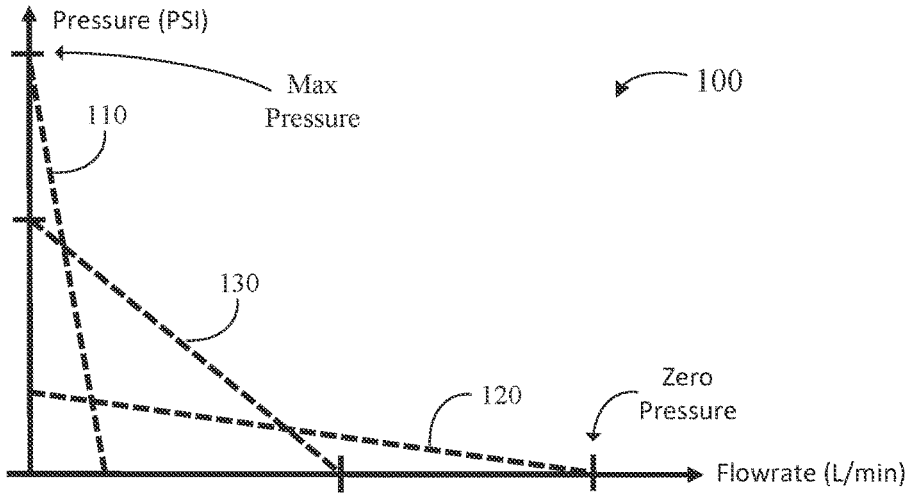
FIG. 1 provides a diagram illustrating examples of conventional pump performance profiles.

FIG. 1 provides a diagram 100 illustrating examples of conventional pump performance profiles. As shown in FIG. 1, a first conventional pump may be designed to have a performance approximating the pump performance profile 110, which is indicative of a high pressure pump. The first conventional pump can handle high pressure conditions, but provides a relatively low flowrate. A second conventional pump may be designed to have a performance approximating the pump performance profile 120, which is indicative of a high flow rate pump. The second conventional pump can provide a high flow rate, but cannot handle high pressure conditions. Since practical operating conditions often include variations in pressure and flow rate, some conventional pumps are designed to have a performance approximating the pump performance profile 130, which is indicative of a moderate flow rate, moderate pressure pump. Such conventional pumps can better handle variations in pressure and flow rate, but cannot perform at the highest pressure or flow rate conditions. Thus, the design of such conventional pumps involves a tradeoff in providing variable performance but at the cost of sacrificing optimal performance at both high pressure and high flow rate conditions.

Figure 2A:
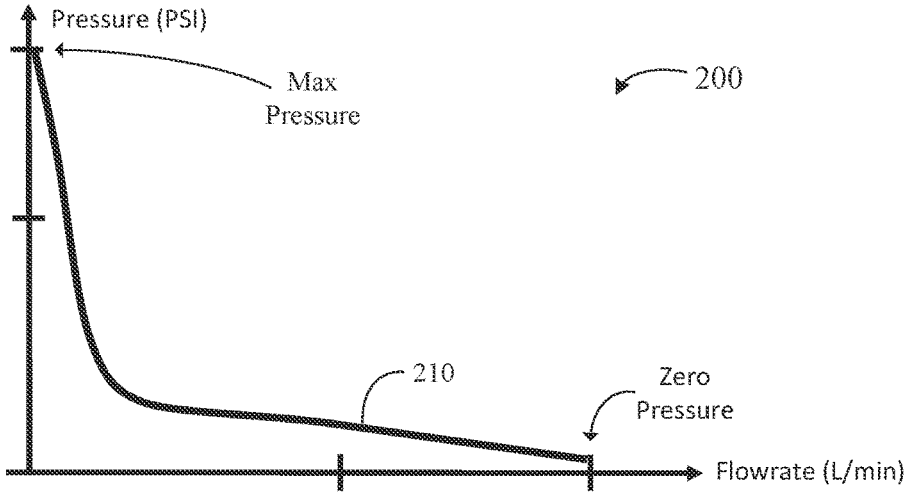
FIGS. 2A-2B provide diagrams illustrating an example of an adaptive programmable pump performance profile according to one or more embodiments.
Figure 2B:
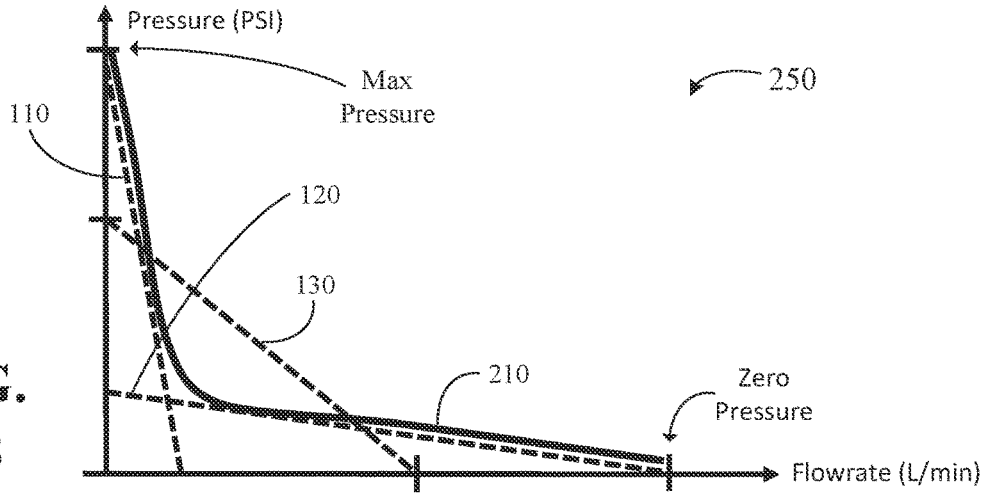

FIGS. 2A and 2B provide diagrams 200 and 250 illustrating an example of a pump performance profile for an adaptive programmable pump according to one or more embodiments, with reference to components and features described herein including but not limited to the figures and associated description. An adaptive programmable pump having a diaphragm with a variable stiffness element as disclosed herein can, for example, be designed to have a performance approximating the pump performance profile 210 shown in FIG. 2A. For comparative purposes, the example pump performance profile 210 for the adaptive programmable pump is shown (as a solid line) in FIG. 2B along with the pump performance profiles 110, 120 and 130 for the conventional pumps (shown in dotted lines as in FIG. 1).

Because the adaptive programmable pump has a diaphragm with a controllable variable stiffness element, the adaptive programmable pump can be programmed to vary the stiffness of the variable stiffness element under different or varying operating conditions. For example, under high pressure conditions, the adaptive programmable pump can be programmed to increase the stiffness of the variable stiffness element, thereby handling high pressure operation that provides a performance approximating that of a high pressure pump; compare the upper part of the curve of the pump performance profile 210 for the adaptive programmable pump with the pump performance profile 110 for the conventional high pressure pump—a performance that the conventional high flow rate pump cannot meet. As another example, under high flow rate conditions, the adaptive programmable pump can be programmed to decrease the stiffness of the variable stiffness element, thereby handling high flow rate operation that provides a performance approximating that of a high flow rate pump; compare the lower part of the curve for the pump performance profile 210 for the adaptive programmable pump with the pump performance profile 130 for the conventional high flow rate pump—a performance that the conventional high pressure pump cannot meet. Thus as illustrated in FIGS. 2A-2B, the adaptive programmable pump as disclosed herein can effectively meet the performance of both the conventional high pressure pump and the conventional high flow rate pump, without the tradeoffs in performance characterized by conventional pumps that approximate the pump performance profile 130.

Figure 3A:
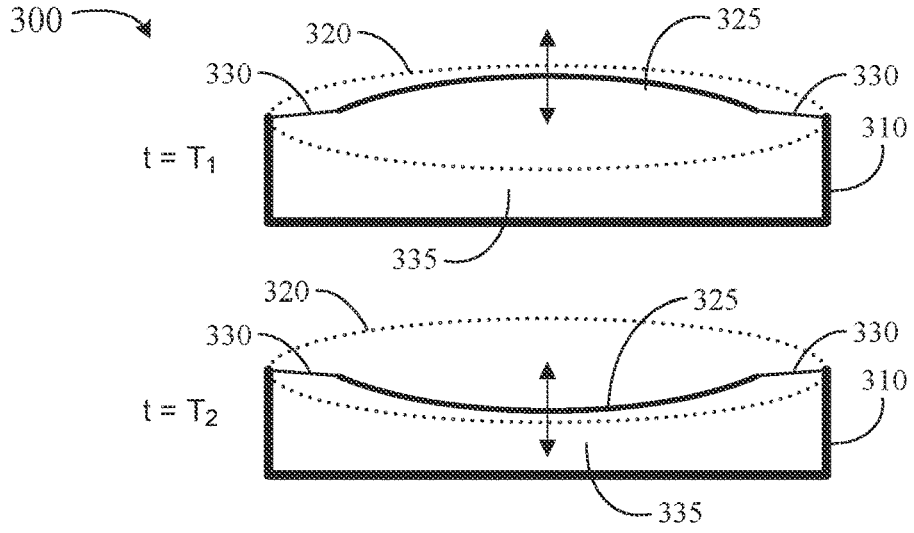
FIGS. 3A-3C provide diagrams illustrating an example of an adaptive programmable pump according to one or more embodiments.
Figure 3B:
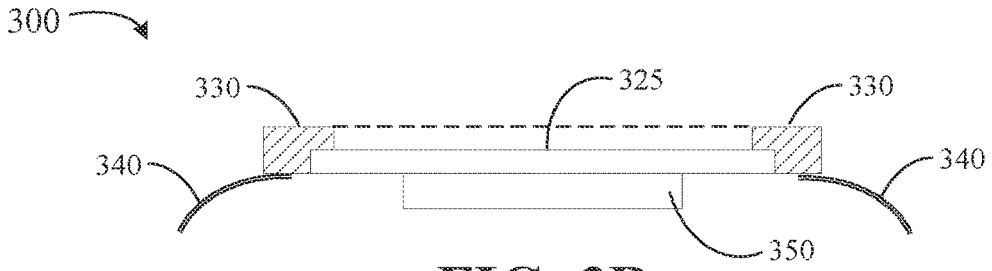
Figure 3C:
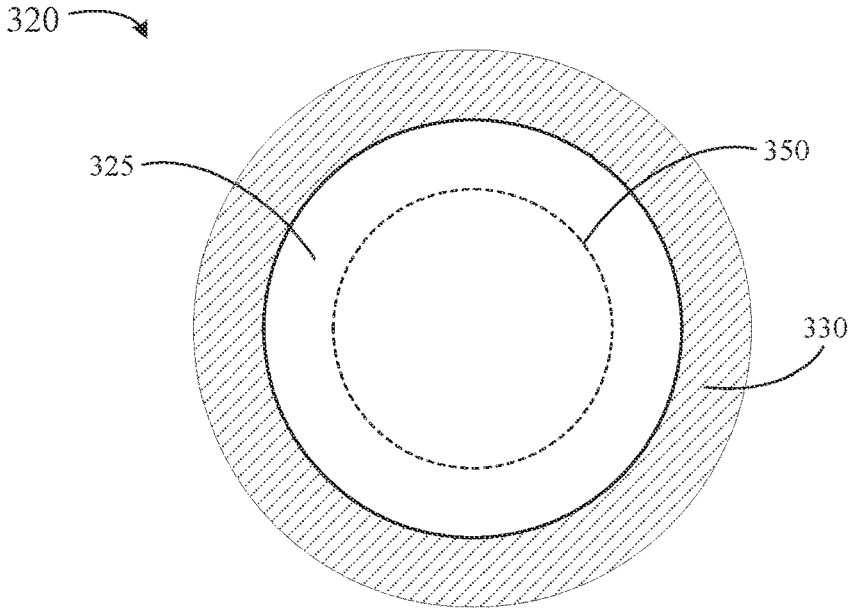

FIGS. 3A-3C provide diagrams illustrating an example of an adaptive programmable pump 300 according to one or more embodiments, with reference to components and features described herein including but not limited to the figures and associated description. Turning to FIG. 3A, side views of the adaptive programmable pump 300 (at different times) are shown. The adaptive programmable pump 300 includes a pump housing 310 and a diaphragm 320 attached to a top side of the pump housing 310. The pump housing 310 can be cylindrical in shape. The wall(s) of the pump housing 310 form a cavity 335 to hold fluid (i.e., a gas). Typically, the pump housing 310 will include inlet and outlet valves on one side (not shown in FIG. 3A) to provide a flow path for the fluid to flow in or out of the cavity 335 during pump operation.

The diaphragm 320 includes a variable stiffness element. In embodiments, the diaphragm 320 includes a thin metal shim 325 and an isolator 330, where the isolator 330 is the variable stiffness element. The isolator 330 is attached to the metal shim 325 and to the pump housing 310 (the isolator is typically attached to the wall(s) of the pump housing 310). The metal shim can be made of a variety of metals, including brass, stainless steel, aluminum, etc. The diaphragm 320 is situated over the cavity 335 in the pump housing.

The isolator 330 is made of a variable stiffness material that can be controlled via application of thermal energy, a magnetic field or an electric field. Examples of the variable stiffness material can include a thermoplastic material-which can be controlled via application of thermal energy; an amorphous metal alloy (such as, e.g., metglas)—which can be controlled via application of a magnetic field; and an electroactive laminate—which can be controlled via application of an electric field.

Figure 5A:
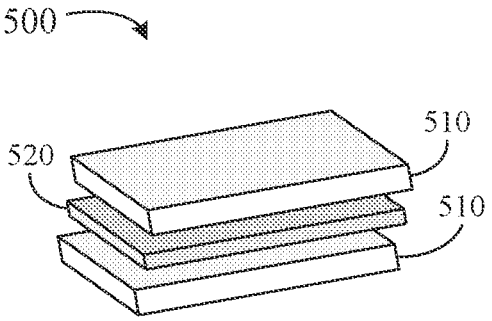
FIGS. 5A-5B provide diagrams illustrating examples of an electroactive laminate for use as a variable stiffness material in an adaptive programmable pump according to one or more embodiments.
Figure 5B:
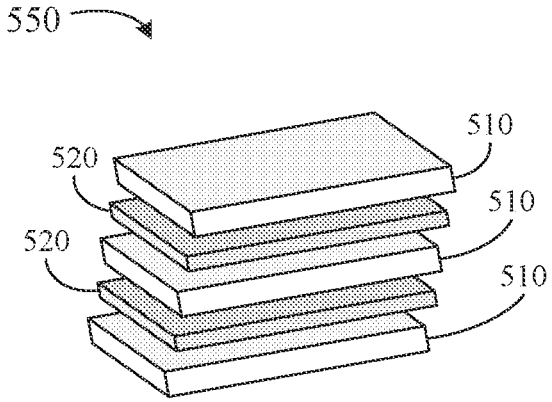

Turning now to FIGS. 5A-5B, illustrated are examples of an electroactive laminate for use as a variable stiffness material in the adaptive programmable pump 300 according to one or more embodiments, with reference to components and features described herein including but not limited to the figures and associated description. The electroactive laminate is comprised of thin, alternating conductive and dielectric layers, including two or more conductive layers 510 and one or more dielectric layers 520. As illustrated in FIG. 5A, the electroactive laminate 500 includes three alternating layers, with two conductive layers 510 surrounding a dielectric layer 520. FIG. 5B illustrates another configuration of an electroactive laminate 550 that includes five alternating layers, with three conductive layers 510 surrounding two dielectric layers 520. Other configurations for an electroactive laminate are possible.

The electroactive laminate can be controlled by applying a voltage across the conductive layers 510. When a voltage is applied, electrostatic attraction (e.g., between conductive and dielectric layers) causes the layers to adhere together which, in turn, causes an increase in the bending stiffness of the laminate. The change in stiffness is related to the number of layers. For example, if no voltage is applied to the laminate, the stiffness is proportional to N (where N is the number of layers in the laminate). When a voltage is applied, the stiffness increases and is proportional to $N^3$. Further details regarding electroactive laminates are described in D. Levine et al., "Materials with Electroprogrammable Stiffness," Advanced Materials 2021, 2007952, the disclosure of which is incorporated by reference herein in its entirety as if set forth herein.

Returning now to FIG. 3A, the diaphragm 320 moves in an upward and downward motion (e.g., at an operating frequency $f_p$) during operation of the adaptive programmable pump 300. For example, the diaphragm 320 can have a piezoelectric element (not shown in FIG. 3A) attached to a surface of the diaphragm 320, and applying an electrical voltage to the piezoelectric element causes the operating motion of the diaphragm 320. Operation of the adaptive programmable pump 300 is illustrated in FIG. 3A at two times, $T_1$ and $T_2$ (of note, the shape of the diaphragm 320 is accentuated for illustrative purposes). At time $t=T_1$, the diaphragm 320 is extended upward, decreasing the pressure and permitting an increase in the volume of gas in the cavity 335 (e.g., via an inlet, not shown in FIG. 3A). At time $t=T_2$, the diaphragm is moving downward which increases the pressure and reduces the volume, thus forcing the gas out of the cavity 335 (e.g., via an outlet, not shown in FIG. 3A).

Turning now to FIG. 3B, another side view of the adaptive programmable pump 300 is shown with additional details relating to the diaphragm 320. The isolator 330 is attached to the metal shim 325. A piezoelectric element 350 is attached to the metal shim 325. An electrical voltage applied to the piezoelectric element 350 causes the operating motion of the diaphragm 320 (as discussed above with reference to FIG. 3A). The diaphragm 320 with the piezoelectric element 350 is known as an actuator.

Additionally, a control element 340 is coupled to the isolator 330 to apply thermal energy, a magnetic field, or an electric field-depending on the type of variable stiffness material in the isolator 330. For example, if the variable stiffness material is a thermoplastic material, the control element 340 can include an electronically resistive wire or film (e.g., nichrome wire or film) that is attached to or wound around the isolator 330 and is responsive to an applied voltage. When a voltage is applied to the electronically resistive wire/film (e.g., across the ends of the electronically resistive wire/film), the electronically resistive wire/film heats up to apply heat to the thermoplastic material in the isolator 330. For example, heating the thermoplastic material to a temperature above its glass transition temperature (Tg) causes the thermoplastic material to a more pliable (e.g., softer) state, which reduces the stiffness of the thermoplastic material in comparison to the stiffness when the thermoplastic material is below Tg.

As another example, if the variable stiffness material is an amorphous metal alloy, the control element 340 can include a wire coil that is wound around the isolator 330 and is responsive to an applied voltage. When a voltage (e.g., alternating current, or AC) is applied to the wire coil, the wire coil generates a magnetic field which is applied to the amorphous metal alloy to cause a change in the stiffness of the amorphous metal alloy. For example, the relationship between the magnetic field strength applied and the stiffness of the amorphous metal alloy is typically a non-linear relationship overall. However, there is a portion where the relationship is approximately linear, such that an increase in the magnetic field strength results in a proportionate (approximately) decrease in stiffness of the amorphous metal alloy. By operating control of the applied magnetic field in this approximate linear region, the stiffness of the amorphous metal alloy can be predictably controlled.

As another example, if the variable stiffness material is an electroactive laminate (e.g., including a dielectric layer 520 arranged between two conductive layers 510), the control element 340 can include wire leads (e.g., electrodes) attached to the conductive layers 510. When a voltage is applied to the wire leads, an electric field is generated within the layers of the electroactive laminate to cause a change in the stiffness of the electroactive laminate. For embodiments with a three-layer electroactive laminate (e.g., a dielectric layer 520 arranged between two conductive layers 510), the control effectively provides an on/off response (e.g., two discrete levels of stiffness). In embodiments with more than the three layers (e.g., three or more conductive layers 510 with two or more dielectric layers 520, a control element 340 can be attached to each conductive layer 510, which enables selective electroactivation of different layers. In turn, this enables finer control, providing three or more levels of discrete stiffness. In some embodiments, the control element 340 (e.g., wire leads) is integrated with the conductive layers 510 of the electroactive laminate.

Turning now to FIG. 3C, a top view of an example diaphragm 320 is shown. The diaphragm 320 as illustrated is circular and includes the metal shim 325, which is circular, and the isolator 330 which, in the configuration shown, is a ring surrounding and attached to the metal shim 325. A dotted outline showing the relative location of the piezoelectric element 350 is also indicated. Other shapes for the diaphragm 320 are possible.

Figure 4A:
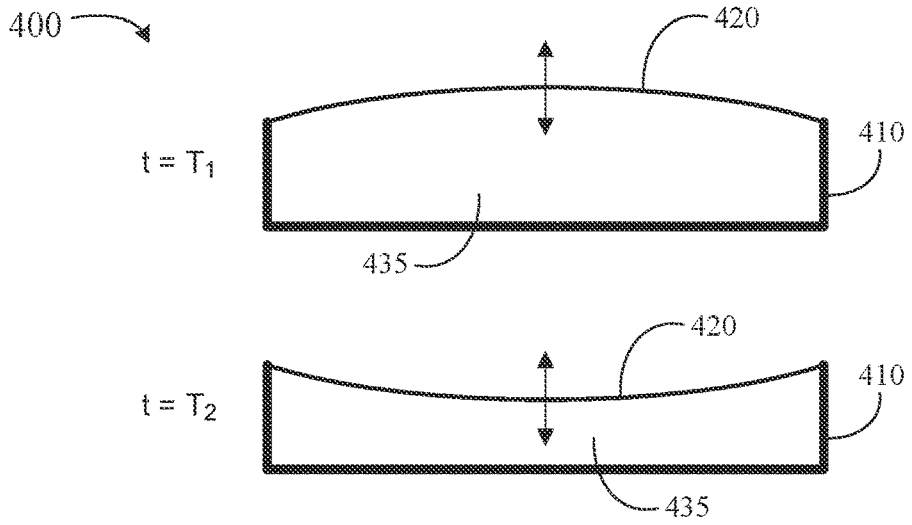
FIGS. 4A-4C provide diagrams illustrating another example of an adaptive programmable pump according to one or more embodiments.
Figure 4B:
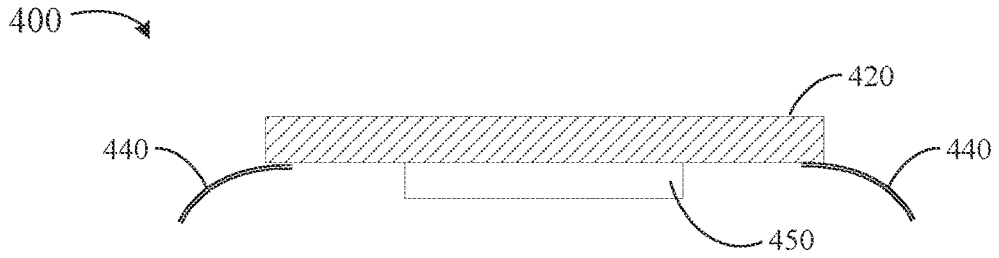
Figure 4C:
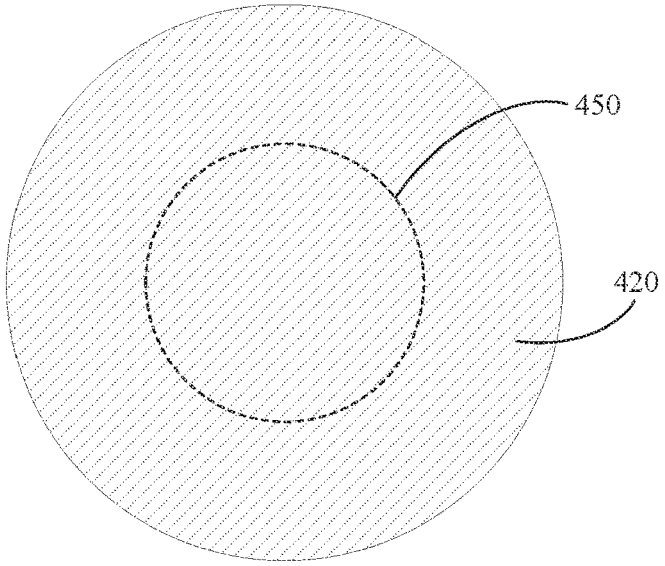

FIGS. 4A-4C provide diagrams illustrating another example of an adaptive programmable pump 400 according to one or more embodiments, with reference to components and features described herein including but not limited to the figures and associated description. Turning to FIG. 4A, side views of the adaptive programmable pump 400 (at different times) are shown. The adaptive programmable pump 400 includes a pump housing 410 and a diaphragm 420 attached to a top side of the pump housing 410. The pump housing 410 can be cylindrical in shape. The wall(s) and bottom of the pump housing 410 form a cavity 435 to hold fluid (i.e., a gas). Typically, the pump housing 410 will include inlet and outlet valves on one side (not shown in FIG. 4A) to provide a flow path for the fluid to flow in or out of the cavity 435 during pump operation.

The diaphragm 420 includes a variable stiffness element. In embodiments, the diaphragm 420 is a one-piece variable stiffness material-without a metal shim—that is attached to the pump housing 410 (the diaphragm 420 is typically attached to the wall(s) of the pump housing 410). The diaphragm 420 is situated over the cavity 435 in the pump housing.

The variable stiffness material of the diaphragm 420 can be controlled via application of thermal energy, a magnetic field or an electric field. Examples of the variable stiffness material can include a thermoplastic material-which can be controlled via application of thermal energy; an amorphous metal alloy (such as, e.g., metglas)—which can be controlled via application of a magnetic field; and an electroactive laminate-which can be controlled via application of an electric field.

During operation of the adaptive programmable pump 400, the diaphragm 420 moves in an upward and downward motion (e.g., at an operating frequency $f_p$). For example, the diaphragm 420 can have a piezoelectric element (not shown in FIG. 4A) attached to a surface of the diaphragm 420, and applying an electrical voltage to the piezoelectric element causes the operating motion of the diaphragm 420. Operation of the adaptive programmable pump 400 is illustrated in FIG. 4A at two times, $T_1$ and $T_2$ (of note, the shape of the diaphragm 420 is accentuated for illustrative purposes). At time $t=T_1$, the diaphragm 420 is extended upward, decreasing the pressure and permitting an increase in the volume of gas in the cavity 435 (e.g., via an inlet, not shown in FIG. 4A). At time $t=T_2$, the diaphragm is moving downward which increases the pressure and reduces the volume, thus forcing the gas out of the cavity 435 (e.g., via an outlet, not shown in FIG. 4A).

Turning now to FIG. 4B, another side view of the adaptive programmable pump 400 is shown with additional details relating to the diaphragm 420. A piezoelectric element 450 is attached to the diaphragm 420. An electrical voltage applied to the piezoelectric element 450 causes the operating motion of the diaphragm 420 (as discussed above with reference to FIG. 4A).

Additionally, a control element 440 is coupled to the diaphragm 420 to apply thermal energy, a magnetic field, or an electric field-depending on the type of variable stiffness material in the diaphragm 420. For example, if the variable stiffness material is a thermoplastic material, the control element 440 can include an electronically resistive wire or film (e.g., nichrome wire or film) that is attached to or wound around the diaphragm 420. When a voltage is applied to the electronically resistive wire/film (e.g., across the ends of the electronically resistive wire/film), the electronically resistive wire/film heats up to apply heat to the thermoplastic material in the isolator 330.

As another example, if the variable stiffness material is an amorphous metal alloy, the control element 340 can include a wire coil that is wound around the diaphragm 420. When a voltage (e.g., alternating current, or AC) is applied to the wire coil, the wire coil generates a magnetic field which is applied to the amorphous metal alloy to cause a change in the stiffness of the amorphous metal alloy.

As another example, if the variable stiffness material is an electroactive laminate (e.g., including a dielectric layer arranged between two conductive layers), the control element 440 can include wire leads (e.g., electrodes) attached to the conductive layers. When a voltage is applied to the wire leads, an electric field is generated to the layers of the electroactive laminate to cause a change in the stiffness of the electroactive laminate. For embodiments with a three-layer electroactive laminate (e.g., a dielectric layer 520 arranged between two conductive layers 510), the control effectively provides an on/off response (e.g., two discrete levels of stiffness). In embodiments with more than the three layers (e.g., three or more conductive layers 510 with two or more dielectric layers 520), a control element 440 can be attached to each conductive layer 510, which enables selective electroactivation of different layers. In turn, this enables finer control, providing three or more levels of discrete stiffness. In some embodiments, the control element 440 (e.g., wire leads) is integrated with the conductive layers 510 of the electroactive laminate.

Turning now to FIG. 4C, a top view of an example diaphragm 420 is shown. The diaphragm 420 as illustrated is a circular, one-piece variable stiffness material. A dotted outline showing the relative location of the piezoelectric element 450 is also indicated. Other shapes for the diaphragm 420 are possible.

Figure 6:
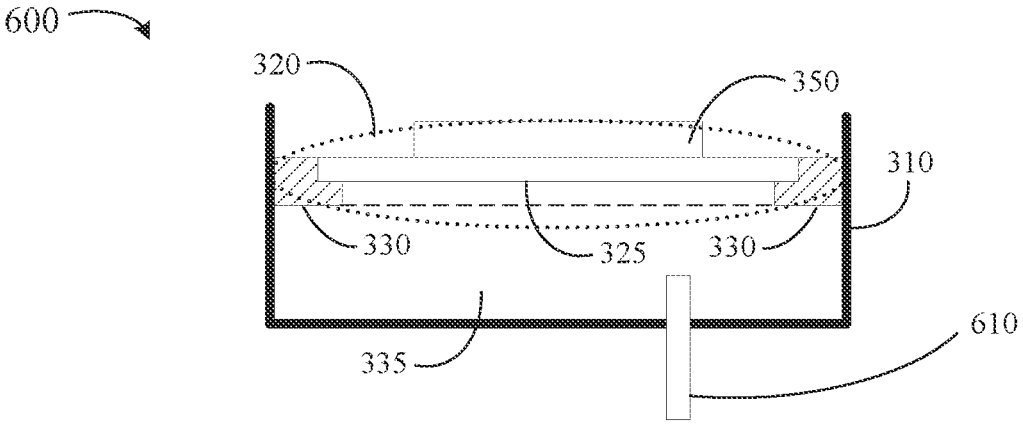
FIG. 6 provides a diagram illustrating aspects of an adaptive programmable pump according to one or more embodiments.

FIG. 6 provides a diagram illustrating aspects of an example adaptive programmable pump according to one or more embodiments, with reference to components and features described herein including but not limited to the figures and associated description. In FIG. 6, a side view of an adaptive programmable pump 600 is shown. The adaptive programmable pump 600 is in a closed volume configuration and can be based on the adaptive programmable pump 300 (FIGS. 3A-3C, already discussed). The adaptive programmable pump 600 includes many or all of the same components and features of the adaptive programmable pump 300, description of which will not be repeated except as necessary to explain the features of the adaptive programmable pump 600. The adaptive programmable pump 600 includes a sensor 610 which is arranged within the pump housing 310). In some embodiments the sensor 610 is a pressure sensor. In some embodiments the sensor 610 is a flow rate sensor.

During operation of the adaptive programmable pump 600 (e.g., via a voltage applied to the piezoelectric element 350), the sensor 610 (e.g., a pressure sensor) can be used to monitor the backpressure within the cavity 335. In some embodiments, the sensor 610 is located in a place other than the pump housing 310 to measure backpressure. For example, in an air pump, the sensor 610 can be located in or adjacent to an outlet valve which is to be connected to an object to be inflated. Other locations for the sensor 610 are possible, so long as the sensor is exposed to the backpressure created during the pumping operation.

Based on the pressure data (e.g., values representing measured pressure) provided by the sensor 610, the stiffness of the variable stiffness material of the isolator 330 can be changed. For example, if the sensor 610 measures increasing backpressure, the adaptive programmable pump 600 can increase the stiffness of the variable stiffness material, thereby enabling the adaptive programmable pump 600 to maintain or increase the pressure needed for the pumping operation. In some embodiments, the configuration of the adaptive programmable pump 600 can be based on the configuration of the adaptive programmable pump 400 (FIGS. 4A-4C, already discussed).

Figure 7:
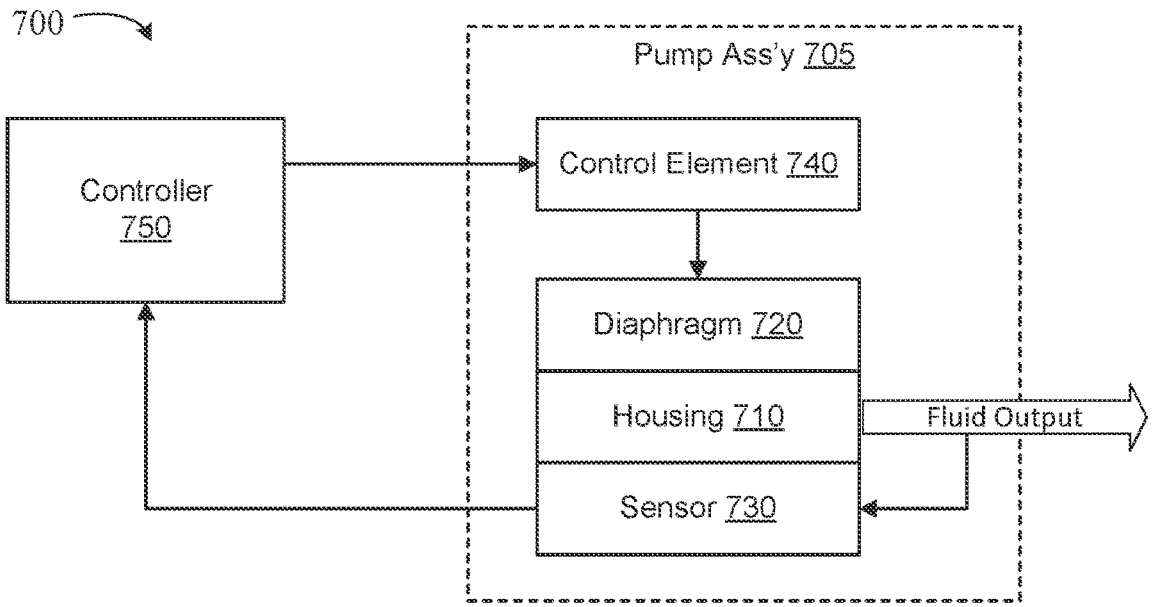
FIG. 7 is a block diagram illustrating an example of an adaptive programmable pump system according to one or more embodiments.

FIG. 7 is a block diagram illustrating an example of an adaptive programmable pump system 700 according to one or more embodiments, with reference to components and features described herein including but not limited to the figures and associated description. The adaptive programmable pump system 700 includes a pump assembly 705 and a controller 750 (which can be programmable). The pump assembly 705 includes a housing 710, a diaphragm 720, a sensor 730 and a control element 740. In embodiments the pump assembly 705 corresponds to, or includes some or all of the components of, the adaptive programmable pump 300 (FIGS. 3A-3C, already discussed). In embodiments the pump assembly 705 corresponds to, or includes some or all of the components of, the adaptive programmable pump 400 (FIGS. 4A-4C, already discussed).

The adaptive programmable pump system 700 operates via a feedback loop to control the stiffness of the variable stiffness element which, in turn, influences the pump operation. The controller 750 provides a control input to the control element 740 to control the variable stiffness element of the diaphragm 720. Through pump operation, a fluid output is generated at the housing 710 (e.g., via an outlet valve of the pump assembly 705, not shown in FIG. 7), and the sensor 730 measures a property of the fluid output (e.g., a backpressure of the fluid output or a flow rate of the fluid output). In some embodiments the sensor 730 measures a property (e.g., backpressure) of the fluid within a cavity of the housing 710.

The sensor 730 senses the environment of the pump assembly 705 and provides feedback about the environment such as, e.g., a property of the fluid output to the controller 750. In some embodiments, the sensor 730 corresponds to the sensor 610 (FIG. 6, already discussed) and provides pressure data. For example, the sensor 730 measures a backpressure of the fluid output from the housing 710 (or backpressure in a cavity of the housing 710) and provides data about the pressure to the controller 750. In some embodiments, the sensor 730 is a flow rate sensor and provides data about the flow rate of the fluid output from the housing 710 to the controller 750. In some embodiments, a piezoelectric element (not shown in FIG. 7, but attached to the diaphragm 720) can be self-sensing to determine the backpressure based on the electrical impedance.

The controller 750 receives input from the sensor 730 (e.g., regarding pressure or flow rate) and provides an output (e.g., a voltage) to the control element 740 to control the stiffness of a variable stiffness element of the pump assembly 710. The control element 740 can correspond to the control element 340 (FIG. 3B, already discussed) or to the control element 440 (FIG. 4B, already discussed). The controller 750 can, upon receiving sensor data (e.g., pressure data or movement data) from the sensor 730, determine the level of stiffness in the variable stiffness element that is required for pump operation. The controller 750 can provide a voltage to the control element 740 that controls (e.g., varies) the stiffness of the variable stiffness element (e.g., the isolator 330 or the diaphragm 420) of the pump assembly 710, as described herein with reference to FIGS. 2A-2B, 3A-3C, 4A-4C and 6. Further details regarding the controller 750 are provided herein with reference to FIG. 8.

As one example, the adaptive programmable pump system 700 can be used to inflate an object such as, e.g., a tire, a ball, etc. with a gas (e.g., air, nitrogen, etc.). As the object inflates with the gas, backpressure in the pump will increase due to the pressure buildup in the object being inflated. The backpressure acts as a resistance to the output flow of the pump. In response to a sensed increase in the backpressure (e.g., via the sensor 730), the controller 750 can, via an applied voltage, cause an increase in the variable stiffness element of the pump assembly 710, thereby enabling the adaptive programmable pump system 700 to maintain or increase the pressure in the output flow to continue inflating the object.

The adaptive programmable pump system 700 can also be used in high flow rate applications. For example, the adaptive programmable pump system 700 can be used with a pneumatic actuator which needs to inflate quickly for fast response time. As another example, the adaptive programmable pump system 700 can be used with an inflatable energy absorbing structure, such as an airbag, which needs to be rapidly inflated. As another example, the adaptive programmable pump system 700 can be used with an inflatable kite, which needs to respond quickly to changes in environment and recover pressure quickly.

Figure 8:
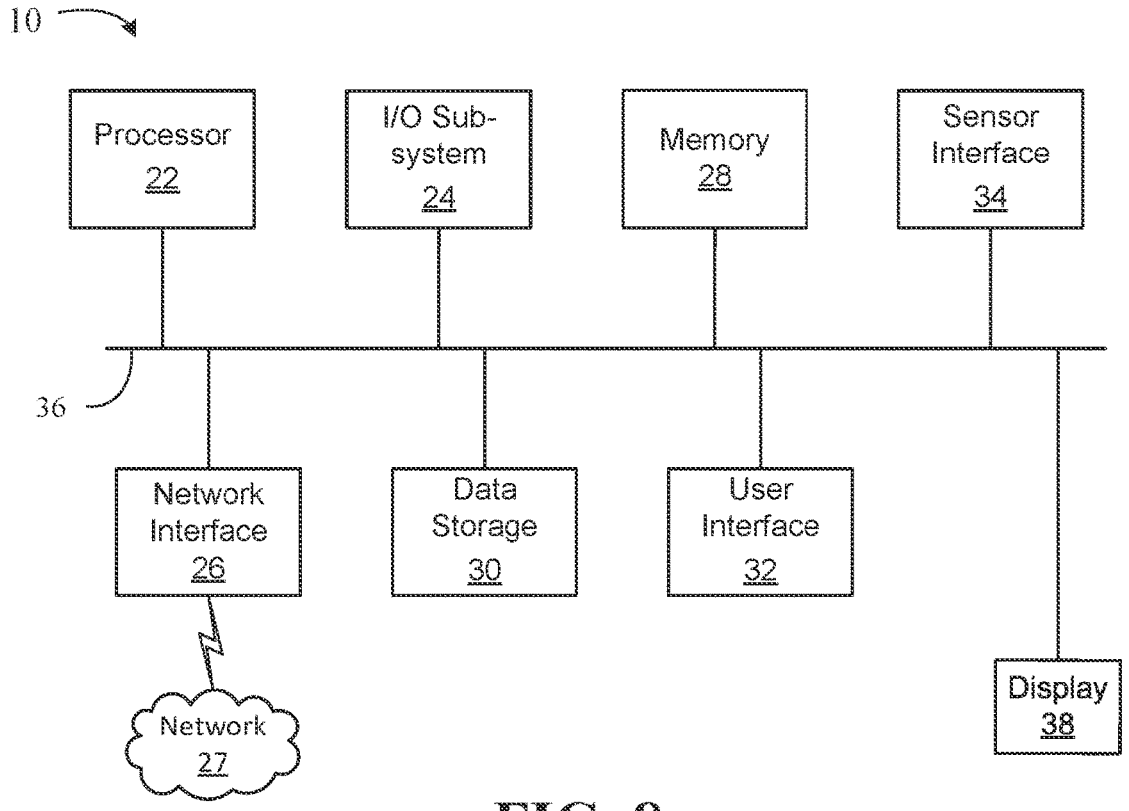
FIG. 8 is a block diagram illustrating an example of a controller for an adaptive programmable pump according to one or more embodiments.

FIG. 8 is a block diagram illustrating an example of a controller 10 for an adaptive programmable pump according to one or more embodiments, with reference to components and features described herein including but not limited to the figures and associated description. The controller 10 can correspond to the controller 750 (FIG. 7, already discussed). Although FIG. 8 illustrates certain components, the controller 10 can include additional or multiple components connected in various ways. It is understood that not all embodiments will necessarily include every component shown in FIG. 8. The controller 10 can include one or more processors 22. The controller 10 can also include an I/O subsystem 24, a network interface 26, a memory 28, a data storage 30, a user interface 32, and/or a sensor interface 34. The controller 10 can also include a display 38. These components are coupled, connected or otherwise in data communication via an interconnect 36. In some embodiments, the controller 10 can interface with a separate display such as, e.g., a display installed as original equipment in the vehicle.

The processor 22 includes one or more processing devices such as a microprocessor, a fixed application-specific integrated circuit (ASIC) processor, a reduced instruction set computing (RISC) processor, a complex instruction set computing (CISC) processor, a field-programmable gate array (FPGA), a digital signal processor (DSP), etc., along with associated circuitry, logic, and/or interfaces. The processor 22 can include, or be connected to, a memory (such as, e.g., the memory 28) storing executable instructions and/or data, as necessary or appropriate. The processor 22 can execute such instructions to implement, control, operate or interface with any devices, components or features of the adaptive programmable pump system 700 and/or any of the devices, components, features or methods described herein with reference to FIGS. 2A-2B, 3A-3C, 4A-4C, 6 and/or 7. The processor 22 can communicate, send, or receive messages, requests, notifications, data, etc. to/from other devices or components, such as the devices/components illustrated in FIG. 8. The processor 22 can be embodied as any type of processor capable of performing the functions described herein. For example, the processor 22 can be embodied as a single or multi-core processor(s), a digital signal processor, a microcontroller, or other processor or processing/controlling circuit. The processor 22 can include embedded instructions (e.g., processor code).

The I/O subsystem 24 can include circuitry and/or components suitable to facilitate input/output operations with the processor 22, the memory 28, and other components of the controller 10. For example, the I/O subsystem 24 can provide control signals (e.g., voltages) to a control element of an adaptive programmable pump (e.g., the control element 740 in FIG. 7).

The network interface 26 can include suitable logic, circuitry, and/or interfaces that transmits and receives data over one or more communication networks using one or more communication network protocols. The network interface 26 can operate under the control of the processor 22, and can transmit/receive various requests and messages to/from one or more other devices or components (such as, e.g., any one or more of the devices or components illustrated in FIG. 7 or 8). The network interface 26 can include wired or wireless data communication capability; these capabilities can support data communication with a wired or wireless communication network, such as the network 27, and further including the Internet, a wide area network (WAN), a local area network (LAN), a wireless personal area network, a wide body area network, a cellular network, a telephone network, any other wired or wireless network for transmitting and receiving a data signal, or any combination thereof (including, e.g., a Wi-Fi network or corporate LAN). The network interface 26 can support communication via a short-range wireless communication field, such as Bluetooth, NFC, or RFID. Examples of network interface 26 can include, but are not limited to, an antenna, a radio frequency transceiver, a wireless transceiver, a Bluetooth transceiver, an ethernet port, a universal serial bus (USB) port, or any other device configured to transmit and receive data.

The memory 28 can include suitable logic, circuitry, and/or interfaces to store executable instructions and/or data, as necessary or appropriate, when executed, to implement, control, operate or interface with any devices, components or features of the adaptive programmable pump system 700 and/or any of the devices, components, features or methods described herein with reference to FIGS. 2A-2B, 3A-3C, 4A-4C, 6 and/or 7. The memory 28 can be embodied as any type of volatile or non-volatile memory or data storage capable of performing the functions described herein, and can include a random-access memory (RAM), a read-only memory (ROM), write-once read-multiple memory (e.g., EEPROM), a removable storage drive, a hard disk drive (HDD), a flash memory, a solid-state memory, and the like, and including any combination thereof. In operation, the memory 28 can store various data and software used during operation of the controller 10 such as operating systems, applications, programs, libraries, and drivers. The memory 28 can be communicatively coupled to the processor 22 directly or via the I/O subsystem 24.

The data storage 30 can include any type of device or devices configured for short-term or long-term storage of data such as, for example, memory devices and circuits, memory cards, hard disk drives, solid-state drives, non-volatile flash memory, or other data storage devices. The data storage 30 can include or be configured as a database, such as a relational or non-relational database, or a combination of more than one database. In some embodiments, a database or other data storage can be physically separate and/or remote from the controller 10, and/or can be located in another computing device, a database server, on a cloudbased platform, or in any storage device that is in data communication with the controller 10.

The user interface 32 can include code to present, on a display, information or screens for a user and to receive input (including commands) from a user via an input device (e.g., a touch-screen device). The user interface 32 can include a graphical user interface (GUI).

The sensor interface 34 can include circuitry and/or components suitable to facilitate communications and/or exchange of data, commands or signals between the controller 10 and one or more sensors, which can include one or more of the sensor 610 (FIG. 6), a flow rate sensor, and or the sensor(s) 730 (FIG. 7).

The interconnect 36 includes any one or more separate physical buses, point to point connections, or both connected by appropriate bridges, adapters, or controllers. The interconnect 36 can include, for example, a system bus, a Peripheral Component Interconnect (PCI) bus, a HyperTransport or industry standard architecture bus, a small computer system interface (SCSI) bus, a universal serial bus (USB), IIC (I2C) bus, or an Institute of Electrical and Electronics Engineers (IEEE) standard 694 bus (e.g., "Firewire"), or any other interconnect suitable for coupling or connecting the components of the controller 10.

The display 38 can be any type of device for presenting visual information, such as a computer monitor, a flat panel display, or a mobile device screen, and can include a liquid crystal display (LCD), a light-emitting diode (LED) display, a plasma panel, or a cathode ray tube display, etc. The display 38 can include a display interface for communicating with the display. In some embodiments, display 38 can include a display interface for communicating with a display external to the controller 10.

In some embodiments, one or more of the illustrative components of the controller 10 can be incorporated (in whole or in part) within, or otherwise form a portion of, another component. For example, the memory 28, or portions thereof, can be incorporated within the processor 22. As another example, the user interface 32 can be incorporated within the processor 22 and/or code in the memory 28. In some embodiments, the controller 10 can be embodied as, without limitation, a mobile computing device, a smartphone, a wearable computing device, an Internet-of-Things device, a laptop computer, a tablet computer, a notebook computer, a computer, a workstation, a server, a multiprocessor system, and/or a consumer electronic device.

Figure 9:
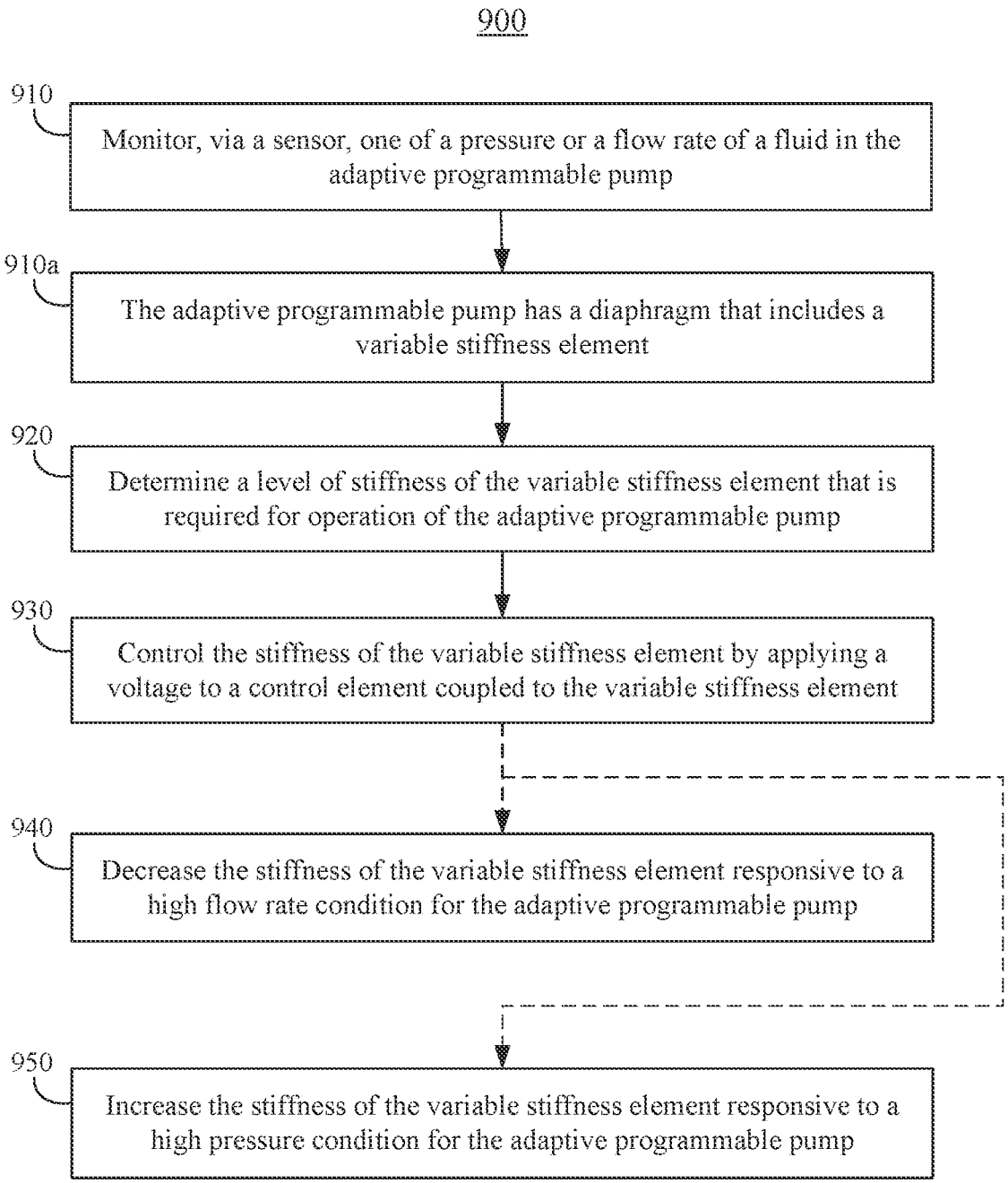
FIG. 9 provides a flow diagram illustrating an example method of controlling an adaptive programmable pump according to one or more embodiments.

FIG. 9 provides a flow diagram illustrating an example method 900 of controlling an adaptive programmable pump according to one or more embodiments, with reference to components and features described herein including but not limited to the figures and associated description. The method 900 can generally be implemented in the adaptive programmable pump system 700 (FIG. 7, already discussed) and/or via components of the controller 10 (FIG. 8, already discussed). More particularly, the method 900 can be implemented as one or more modules as a set of logic instructions stored in a machine- or computer-readable storage medium such as RAM, ROM, PROM, firmware, flash memory, etc., in hardware, or any combination thereof. For example, hardware implementations can include configurable logic, fixed-functionality logic, or any combination thereof. Examples of configurable logic include suitably configured PLAs, FPGAs, CPLDs, and general purpose microprocessors. Examples of fixed-functionality logic include suitably configured ASICs, combinational logic circuits, and sequential logic circuits. The configurable or fixed-functionality logic can be implemented with CMOS logic circuits, TTL logic circuits, or other circuits.

For example, computer program code to carry out operations shown in the method 900 and/or functions associated therewith can be written in any combination of one or more programming languages, including an object oriented programming language such as JAVA, SMALLTALK, C++ or the like and conventional procedural programming languages, such as the "C" programming language or similar programming languages. Additionally, program or logic instructions might include assembler instructions, instruction set architecture (ISA) instructions, machine instructions, machine dependent instructions, microcode, state-setting data, configuration data for integrated circuitry, state information that personalizes electronic circuitry and/or other structural components that are native to hardware (e.g., host processor, central processing unit/CPU, microcontroller, etc.).

Illustrated processing block 910 provides for monitoring, via a sensor, one of a pressure or a flow rate of a fluid in the adaptive programmable pump, where at block 910*a* the adaptive programmable pump comprises a diaphragm that includes a variable stiffness element. Illustrated processing block 920 provides for determining a level of a stiffness of the variable stiffness element that is required for operation of the adaptive programmable pump. Illustrated processing block 930 provides for controlling the stiffness of the variable stiffness element by applying a voltage to a control element coupled to the variable stiffness element.

In some embodiments, at illustrated processing block 940 controlling the stiffness of the variable stiffness element includes decreasing the stiffness of the variable stiffness element responsive to a high flow rate condition for the adaptive programmable pump. A high flow rate condition can include a condition requiring an increased flow rate (e.g., relative to current flow rate). In some embodiments, at illustrated processing block 950 controlling the stiffness of the variable stiffness element further includes increasing the stiffness of the variable stiffness element responsive to a high pressure condition for the adaptive programmable pump. A high pressure condition can include a condition requiring an increased pressure (e.g., relative to current pressure). In some embodiments, the sensor includes one of a flow rate sensor or a pressure sensor.

In some embodiments, the variable stiffness element includes a thermoplastic material, and controlling the stiffness of the variable stiffness element includes applying heat to the thermoplastic material to cause a change in the stiffness of the thermoplastic material.

In some embodiments, the variable stiffness element includes an amorphous metal alloy, and controlling the stiffness of the variable stiffness element includes applying a magnetic field to the amorphous metal alloy to cause a change in the stiffness of the amorphous metal alloy.

In some embodiments, the variable stiffness element includes an electroactive laminate including a dielectric layer arranged between two conductive layers, and controlling the stiffness of the variable stiffness element includes applying an electric field to the electroactive laminate to cause a change in the stiffness of the electroactive laminate.

Embodiments of each of the above systems, devices, components, features and/or methods, including the adaptive programmable pump system 700, the controller 750, and/or the method 900, and/or any other system components, can be implemented in hardware, software, or any suitable combination thereof. For example, hardware implementations can include configurable logic, fixed-functionality logic, or any combination thereof. Examples of configurable logic include suitably configured PLAs, FPGAs, CPLDs, and general purpose microprocessors. Examples of fixed-functionality logic include suitably configured ASICs, combinational logic circuits, and sequential logic circuits. The configurable or fixed-functionality logic can be implemented with CMOS logic circuits, TTL logic circuits, or other circuits.

Alternatively, or additionally, all or portions of the foregoing systems, devices, components, features and/or methods can be implemented in one or more modules as a set of program or logic instructions stored in a machine- or computer-readable storage medium such as RAM, ROM, PROM, firmware, flash memory, etc., to be executed by a processor or computing device. For example, computer program code to carry out the operations of the components can be written in any combination of one or more operating system (OS) applicable/appropriate programming languages, including an object-oriented programming language such as PYTHON, PERL, JAVA, SMALLTALK, C++, C# or the like and conventional procedural programming languages, such as the "C" programming language or similar programming languages.

ADDITIONAL NOTES AND EXAMPLES

Example A1 includes an adaptive programmable pump comprising a pump housing, a diaphragm comprising a variable stiffness element attached to the pump housing, a piezoelectric element operatively connected to the diaphragm, and a control element coupled to the variable stiffness element, wherein the control element is configured to control a stiffness of the variable stiffness element via a voltage applied to the control element.

Example A2 includes the adaptive programmable pump of Example A1, further comprising a controller configured to one or more of decrease the stiffness of the variable stiffness element responsive to a high flow rate condition for the adaptive programmable pump or increase the stiffness of the variable stiffness element responsive to a high pressure condition for the adaptive programmable pump.

Example A3 includes the adaptive programmable pump of Example A1 or A2, further comprising a pressure sensor to sense a backpressure relating to operation of the adaptive programmable pump, wherein the controller is to increase the stiffness of the variable stiffness element responsive to a sensed increase in the backpressure.

Example A4 includes the adaptive programmable pump of Example A1, A2 or A3, further comprising a flow rate sensor to sense a flow rate relating to operation of the adaptive programmable pump, wherein the controller is to decrease the stiffness of the variable stiffness element responsive to a sensed decrease in the flow rate.

Example A5 includes the adaptive programmable pump of any of Examples A1-A4, wherein the variable stiffness element comprises a thermoplastic material, and wherein the control element is to apply heat to the thermoplastic material to cause a change in a stiffness of the thermoplastic material.

Example A6 includes the adaptive programmable pump of any of Examples A1-A5, wherein the variable stiffness element comprises an amorphous metal alloy, and wherein the control element is to apply a magnetic field to the amorphous metal alloy to cause a change in a stiffness of the amorphous metal alloy.

Example A7 includes the adaptive programmable pump of any of Examples A1-A6, wherein the variable stiffness element comprises an electroactive laminate including a dielectric layer arranged between two conductive layers, and wherein the control element is to apply an electric field to the electroactive laminate to cause a change in a stiffness of the electroactive laminate.

Example A8 includes the adaptive programmable pump of any of Examples A1-A7, wherein the variable stiffness element includes an isolator, and wherein the diaphragm further comprises a metal shim attached to the isolator.

Example M1 includes a method of controlling an adaptive programmable pump comprising monitoring, via a sensor, one of a pressure or a flow rate of a fluid in the adaptive programmable pump, wherein the adaptive programmable pump comprises a diaphragm that includes a variable stiffness element, determining a level of a stiffness of the variable stiffness element that is required for operation of the adaptive programmable pump, and controlling the stiffness of the variable stiffness element by applying a voltage to a control element coupled to the variable stiffness element.

Example M2 includes the method of Example M1, wherein controlling the stiffness of the variable stiffness element comprises one or more of decreasing the stiffness of the variable stiffness element responsive to a high flow rate condition for the adaptive programmable pump or increasing the stiffness of the variable stiffness element responsive to a high pressure condition for the adaptive programmable pump.

Example M3 includes the method of Example M1 or M2, wherein the sensor includes one of a flow rate sensor or a pressure sensor.

Example M4 includes the method of Example M1, M2 or M3, wherein the variable stiffness element comprises a thermoplastic material, and wherein controlling the stiffness of the variable stiffness element comprises applying heat to the thermoplastic material to cause a change in a stiffness of the thermoplastic material.

Example M5 includes the method of any of Examples M1-M4, wherein the variable stiffness element comprises an amorphous metal alloy, and wherein controlling the stiffness of the variable stiffness element comprises applying a magnetic field to the amorphous metal alloy to cause a change in a stiffness of the amorphous metal alloy.

Example M6 includes the method of any of Examples M1-M5, wherein the variable stiffness element comprises an electroactive laminate including a dielectric layer arranged between two conductive layers, and wherein controlling the stiffness of the variable stiffness element comprises applying an electric field to the electroactive laminate to cause a change in a stiffness of the electroactive laminate.

Example C1 includes at least one non-transitory computer readable storage medium comprising instructions which, when executed by a controller, cause the controller to perform operations comprising monitoring, via a sensor, one of a pressure or a flow rate of a fluid in an adaptive programmable pump, wherein the adaptive programmable pump comprises a diaphragm that includes a variable stiffness element, determining a level of a stiffness of the variable stiffness element that is required for operation of the adaptive programmable pump, and controlling the stiffness of the variable stiffness element by applying a voltage to a control element coupled to the variable stiffness element.

Example C2 includes the at least one non-transitory computer readable storage medium of Example C1, wherein controlling the stiffness of the variable stiffness element comprises one or more of decreasing the stiffness of the variable stiffness element responsive to a high flow rate condition for the adaptive programmable pump or increasing the stiffness of the variable stiffness element responsive to a high pressure condition for the adaptive programmable pump.

Example C3 includes the at least one non-transitory computer readable storage medium of Example C1 or C2, wherein the sensor includes one of a flow rate sensor or a pressure sensor.

Example C4 includes the at least one non-transitory computer readable storage medium of Example C1, C2 or C3, wherein the variable stiffness element comprises a thermoplastic material, and wherein controlling the stiffness of the variable stiffness element comprises applying heat to the thermoplastic material to cause a change in a stiffness of the thermoplastic material.

Example C5 includes the at least one non-transitory computer readable storage medium of any of Examples C1-C4, wherein the variable stiffness element comprises an amorphous metal alloy, and wherein controlling the stiffness of the variable stiffness element comprises applying a magnetic field to the amorphous metal alloy to cause a change in a stiffness of the amorphous metal alloy.

Example C6 includes the at least one non-transitory computer readable storage medium of any of Examples C1-C5, wherein the variable stiffness element comprises an electroactive laminate including a dielectric layer arranged between two conductive layers, and wherein controlling the stiffness of the variable stiffness element comprises applying an electric field to the electroactive laminate to cause a change in a stiffness of the electroactive laminate.

Example AMI includes an apparatus comprising means for performing the method of any of Examples M1 to M6.

Embodiments are applicable for use with all types of semiconductor integrated circuit ("IC") chips. Examples of these IC chips include but are not limited to processors, controllers, chipset components, programmable logic arrays (PLAs), memory chips, network chips, systems on chip (SoCs), SSD/NAND controller ASICs, and the like. In addition, in some of the drawings, signal conductor lines are represented with lines. Some may be different, to indicate more constituent signal paths, have a number label, to indicate a number of constituent signal paths, and/or have arrows at one or more ends, to indicate primary information flow direction. This, however, should not be construed in a limiting manner. Rather, such added detail may be used in connection with one or more exemplary embodiments to facilitate easier understanding of a circuit. Any represented signal lines, whether or not having additional information, may actually comprise one or more signals that may travel in multiple directions and may be implemented with any suitable type of signal scheme, e.g., digital or analog lines implemented with differential pairs, optical fiber lines, and/or single-ended lines.

Example sizes/models/values/ranges may have been given, although embodiments are not limited to the same. As manufacturing techniques (e.g., photolithography) mature over time, it is expected that devices of smaller size could be manufactured. In addition, well known power/ground connections to IC chips and other components may or may not be shown within the figures, for simplicity of illustration and discussion, and so as not to obscure certain aspects of the embodiments. Further, arrangements may be shown in block diagram form in order to avoid obscuring embodiments, and also in view of the fact that specifics with respect to implementation of such block diagram arrangements are highly dependent upon the platform within which the embodiment is to be implemented, i.e., such specifics should be well within purview of one skilled in the art. Where specific details (e.g., circuits) are set forth in order to describe example embodiments, it should be apparent to one skilled in the art that embodiments can be practiced without, or with variation of, these specific details. The description is thus to be regarded as illustrative instead of limiting.

The term "coupled" may be used herein to refer to any type of relationship, direct or indirect, between the components in question, and may apply to electrical, mechanical, fluid, optical, electromagnetic, electromechanical or other connections, including logical connections via intermediate components (e.g., device A may be coupled to device C via device B). In addition, the terms "first", "second", etc. may be used herein only to facilitate discussion, and carry no particular temporal or chronological significance unless otherwise indicated.

As used in this application and in the claims, a list of items joined by the term "one or more of" may mean any combination of the listed terms. For example, the phrases "one or more of A, B or C" may mean A, B, C; A and B; A and C; B and C; or A, B and C.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

We claim:

1. An adaptive programmable pump comprising:

a pump housing;

a diaphragm comprising a variable stiffness element attached to the pump housing, wherein the variable stiffness element comprises a thermoplastic material;

a piezoelectric element operatively connected to the diaphragm;

a control element coupled to the variable stiffness element, wherein the control element comprises an electrically resistive wire or film;

wherein when a voltage is applied to the control element, the control element is to control a stiffness of the variable stiffness element by applying heat to the thermoplastic material to cause a change in the stiffness of the thermoplastic material; and further comprising a controller configured to one or more of decrease the stiffness of the variable stiffness element responsive to a high flow rate condition for the adaptive programmable pump or increase the stiffness of the variable stiffness element responsive to a high pressure condition for the adaptive programmable pump.

2. The adaptive programmable pump of claim 1, further comprising a pressure sensor to sense a backpressure relating to operation of the adaptive programmable pump, wherein the controller is to increase the stiffness of the variable stiffness element responsive to a sensed increase in the backpressure.

3. The adaptive programmable pump of claim 1, further comprising a flow rate sensor to sense a flow rate relating to operation of the adaptive programmable pump, wherein the controller is to decrease the stiffness of the variable stiffness element responsive to a sensed decrease in the flow rate.

4. The adaptive programmable pump of claim 1, wherein the variable stiffness element comprises an isolator attached to the pump housing.

5. The adaptive programmable pump of claim 4, wherein the diaphragm further comprises a metal shim attached to the isolator.

6. The adaptive programmable pump of claim 1, wherein the electrically resistive wire or film comprises a nichrome wire or film.

7. A method of controlling an adaptive programmable pump comprising:

monitoring, via a sensor, one of a pressure or a flow rate of a fluid in the adaptive programmable pump, wherein the adaptive programmable pump comprises a diaphragm that includes a variable stiffness element, and wherein the variable stiffness element comprises a thermoplastic material;

determining a level of a stiffness of the variable stiffness element that is required for operation of the adaptive programmable pump;

controlling the stiffness of the variable stiffness element by applying a voltage to a control element coupled to the variable stiffness element, wherein the control element comprises an electrically resistive wire or film, wherein when the voltage is applied to the control element, the control element controls the stiffness of the variable stiffness element by applying heat to the thermoplastic material to cause a change in the stiffness of the thermoplastic material, and wherein controlling the stiffness of the variable stiffness element comprises one or more of decreasing the stiffness of the variable stiffness element responsive to a high flow rate condition for the adaptive programmable pump or increasing the stiffness of the variable stiffness element responsive to a high pressure condition for the adaptive programmable pump.

8. The method of claim 7, wherein the sensor includes one of a flow rate sensor or a pressure sensor.

9. The method of claim 7, wherein the variable stiffness element comprises an isolator attached to the pump housing and wherein the diaphragm further comprises a metal shim attached to the isolator.

10. The method of claim 7, wherein the electrically resistive wire or film comprises a nichrome wire or film.

11. At least one non-transitory computer readable storage medium comprising instructions which, when executed by a controller, cause the controller to perform operations comprising:

monitoring, via a sensor, one of a pressure or a flow rate of a fluid in an adaptive programmable pump, wherein the adaptive programmable pump comprises a diaphragm that includes a variable stiffness element, and wherein the variable stiffness element comprises a thermoplastic material;

determining a level of a stiffness of the variable stiffness element that is required for operation of the adaptive programmable pump;

controlling the stiffness of the variable stiffness element by applying a voltage to a control element coupled to the variable stiffness element, wherein the control element comprises an electrically resistive wire or film, wherein when the voltage is applied to the control element, the control element controls the stiffness of the variable stiffness element by applying heat to the thermoplastic material to cause a change in the stiffness of the thermoplastic material, and wherein controlling the stiffness of the variable stiffness element comprises one or more of decreasing the stiffness of the variable stiffness element responsive to a high flow rate condition for the adaptive programmable pump or increasing the stiffness of the variable stiffness element responsive to a high pressure condition for the adaptive programmable pump.

12. The at least one non-transitory computer readable storage medium of claim 11, wherein the sensor includes one of a flow rate sensor or a pressure sensor.

13. The at least one non-transitory computer readable storage medium of claim 11, wherein the variable stiffness element comprises an isolator attached to the pump housing and wherein the diaphragm further comprises a metal shim attached to the isolator.

14. The at least one non-transitory computer readable storage medium of claim 7, wherein the electrically resistive wire or film comprises a nichrome wire or film.

* * * * *